US008962542B2

(12) United States Patent
Honary et al.

(10) Patent No.: US 8,962,542 B2
(45) Date of Patent: Feb. 24, 2015

(54) PROCESS AND APPARATUS FOR MANUFACTURING GREASE

(75) Inventors: Lou A. T. Honary, Cedar Falls, IA (US); Wesley E. James, Waterloo, IA (US)

(73) Assignee: University of Northern Iowa Research Foundation, Cedar Falls, IA (US)

( * ) Notice: Subject to any disclaimer, the term of this patent is extended or adjusted under 35 U.S.C. 154(b) by 685 days.

(21) Appl. No.: 13/265,607

(22) PCT Filed: Apr. 22, 2010

(86) PCT No.: PCT/US2010/032094

§ 371 (c)(1), (2), (4) Date: Mar. 14, 2012

(87) PCT Pub. No.: WO2010/124118

PCT Pub. Date: Oct. 28, 2010

(65) Prior Publication Data

US 2013/0029887 A1 Jan. 31, 2013

Related U.S. Application Data

(60) Provisional application No. 61/171,708, filed on Apr. 22, 2009.

(51) Int. Cl.

| | |
|---|---|
| ***C10M 117/00*** | (2006.01) |
| ***C10M 117/02*** | (2006.01) |
| ***C10M 177/00*** | (2006.01) |
| ***C10M 117/04*** | (2006.01) |

(52) U.S. Cl.

CPC ..... *C10M 177/00* (2013.01); *C10M 117/02* (2013.01); *C10M 117/04* (2013.01); *C10M 2207/1265* (2013.01); *C10M 2207/1285* (2013.01); *C10N 2240/02* (2013.01); *C10N 2250/10* (2013.01)

USPC ..... 508/539; 508/150; 219/678

(58) Field of Classification Search

USPC ..... 508/150, 539; 219/678

See application file for complete search history.

(56) References Cited

U.S. PATENT DOCUMENTS

| | | | | |
|---|---|---|---|---|
| 6,100,226 | A * | 8/2000 | Konzman et al. | 508/423 |
| 2005/0197259 | A1 | 9/2005 | Levy | |
| 2005/0274065 | A1 | 12/2005 | Portnoff | |
| 2008/0161213 | A1 * | 7/2008 | Jao et al. | 508/165 |
| 2009/0062165 | A1 | 3/2009 | Denis | |

FOREIGN PATENT DOCUMENTS

| | | |
|---|---|---|
| WO | 2010124118 | 10/2010 |

* cited by examiner

*Primary Examiner* — James Goloboy

(74) *Attorney, Agent, or Firm* — Fredrikson & Byron, P.A.

(57) ABSTRACT

A process and corresponding apparatus and system for use in preparing soaps from fatty acid containing oil compositions, and in turn, for preparing greases by the use of such soaps in combination with one or more base oils.

7 Claims, 5 Drawing Sheets

| 90 Sec Microwave* Exposure | Temperature | Temperature after |
|---|---|---|
| Sample | at start (°C) | 90 Sec. (°C) |
| HOBO** | 22 | 109 |
| Mineral Oil | 23 | 39 |
| 5/95 HOBO/ Mineral Oil | 23 | 44 |
| 10/90 HOBO/ Mineral Oil | 24 | 51 |
| 25/75 HOBO/ Mineral Oil | 24 | 60 |
| 50/50 HOBO/ Mineral Oil | 23 | 75 |
| 75/25 HOBO/ Mineral Oil | 23 | 96 |
| * 1.75KW microwave input<br>* * HOBO = High Oleic Bean Oil | | |

| 90 Sec Microwave* Exposure | Temperature | Temperature after |
|---|---|---|
| Sample | at start (ºC) | 90 Sec. (ºC) |
| HOBO** | 22 | 109 |
| Mineral Oil | 23 | 39 |
| 5/95 HOBO/ Mineral Oil | 23 | 44 |
| 10/90 HOBO/ Mineral Oil | 24 | 51 |
| 25/75 HOBO/ Mineral Oil | 24 | 60 |
| 50/50 HOBO/ Mineral Oil | 23 | 75 |
| 75/25 HOBO/ Mineral Oil | 23 | 96 |
| | | |
| * 1.75KW microwave input<br>* * HOBO = High Oleic Bean Oil | | |

Figure 1

Oil Compositions
Figure 5

| Oil | OSI (hours) | TAN | Flash Point (PM) | Flash Point (COC) | Fire Point (COC) | Pour Point (°C) | Cloud Point (°C) | Viscosity @ 40 | Viscosity @ 100 | Viscosity Index | 4 Ball Wear | Pin & Vee (ref. load lbs) |
|---|---|---|---|---|---|---|---|---|---|---|---|---|
| Apricot Kernel | 23.42 | 0.2844 | 284.5 | 324 | 348 | -16 | -10.8 | 36.49 | 8.202 | 210 | 0.615 | 1732 |
| Avocado | 18.53 | 0.185 | | 320 | 348 | -3 | -0.2 | 39.26 | 8.432 | 199 | 0.609 | 1975 |
| Babassu | 57.8 | N/A | | | | N/A | N/A | 28.65 | 6.133 | 170 | 0.586 | 1706 |
| Castor | 105.13 | 0.252 | | 300 | 320 | -28 | N/A | 249.5 | 19.02 | 85 | 0.633 | 1674 |
| Coconut | 75.38 | N/A | | | | N/A | N/A | 27.8 | 5.947 | 167 | 0.504 | 1738 |
| Corn | 3.73 | 0.198 | | 324 | 346 | -15 | -10.2 | 32.58 | 7.72 | 220 | 0.628 | 1997 |
| Cottonseed | 4.35 | 0.13 | 262 | | | -6 | -3.7 | 34.23 | 7.911 | 215 | 0.588 | 1812 |
| Flaxseed | 1.17 | 0.8399 | 268 | 322 | 348 | -12 | -7.4 | 27.35 | 7.112 | 243 | 0.639 | 1622 |
| Grapeseed | 2.83 | 0.229 | 248 | | | -12 | -6.9 | 33.28 | 7.858 | 220 | 0.623 | 1736 |
| Hempseed | 0.10 | 1.6488 | 248 | | | -15.8 | -28 | 26.71 | 6.972 | 242 | 0.608 | 1556 |
| Jojoba – refined | 42.15 | 0.13 | | 304 | 330 | 9 | 9 | 25.1 | 6.519 | 234 | 0.630 | 1673 |
| Jojoba – golden | 38.3 | 0.752 | | 304 | 330 | 10.7 | 8 | 24.82 | 6.452 | 233 | 0.606 | 1558 |
| Lard | | N/A | | | | N/A | N/A | N/A | 8.543 | N/A | | 1676 |
| Macadamia | 6.87 | 0.126 | 276 | | | -5 | -1.9 | 39.24 | 8.441 | 200 | 0.594 | 1797 |
| Oleic acid | | | | | | 3 | 5.9 | 19.05 | 4.778 | 186 | | 1341 |
| Olive | 5.08 | 0.132 | | 316 | 342 | -6 | -5.4 | 37.56 | 8.242 | 203 | 0.616 | 1683 |
| Palm Kernel | | N/A | | | | N/A | N/A | 31.96 | 6.606 | 169 | | 1622 |
| Palm | 21.52 | N/A | | | | N/A | N/A | 41.77 | 8.56 | 189 | | 1726 |
| Poppyseed | 17.86 | 0.151 | 256 | | | -18 | -15.5 | 30.52 | 7.46 | 226 | 0.601 | 1908 |
| Ricebran | 20.82 | 0.194 | 248 | | | -9 | -3.9 | 36.49 | 8.177 | 208 | 0.581 | 1549 |
| Ricinoleic acid | 117.1 | | 253 | | | -19 | -5.5 | | | | 0.519 | 1277 |
| Safflower | 17.98 | 0.1268 | | 322 | 350 | -22 | 0.4 | 37.9 | 8.325 | 206 | 0.634 | 1660 |
| Sesame | 5.8 | 0.136 | 266 | | | -9 | -5.7 | 34.1 | 7.923 | 216 | 0.49 | 1842 |
| Soy | 17.67 | 0.1602 | 292 | 328 | 346 | -9 | -5.1 | 31.08 | 7.552 | 226 | 0.601 | 1835 |
| Soy HOBO (08-204) | | 0.2346 | 248 | | | -12 | -9.9 | 39.12 | 8.492 | 203 | 0.608 | 1768 |
| Sunflower | 10.23 | 0.132 | 272 | | | -15 | -9.9 | 38.58 | 8.453 | 205 | 0.621 | 1864 |
| Walnut | 16.48 | 0.1269 | | 322 | 346 | -19 | -14.5 | 29.91 | 7.441 | 232 | 0.584 | 1887 |

PROCESS AND APPARATUS FOR MANUFACTURING GREASE

CROSS-REFERENCE TO RELATED APPLICATIONS

The present application claims priority to International Application No. PCT/US2010/032094 filed 22 Apr. 2010, which in turn claims priority to U.S. Provisional Application No. 61/171,708 filed 22 Apr. 2009, the teachings of all of which are incorporated herein by reference.

TECHNICAL FIELD

The present invention relates to processes and apparatuses for manufacturing grease.

BACKGROUND OF THE INVENTION

The process of making grease has remained largely unchanged for several decades. Recent developments, however, hold the promise of some major changes for both the materials and the processes employed, and suggest a change in the overall grease making approach. Since the majority of the grease produced worldwide is based upon the use of either lithium or lithium complex, most of these efforts tie into the production of lithium based greases. Simultaneously, there has been a growing interest in the production of biobased and biodegradable greases, using vegetable oils as the base oil. The use of these newer raw materials has introduced a different level of complexity, and sometimes unpredictability to grease making. For soap based greases, the majority of the processes are similar and require reacting the base oil with soap as a thickener, at high temperatures typically exceeding 200° C.

Interesting new processes for grease making have also been attempted, some of which have shown success in increasing the predictability of final products. Those processes include:

a) introduction of pressurized contactors
b) introduction of continuous (vs. batch) processes
c) alternative heating techniques Finally, a promising change in the manufacturing of grease is the introduction of vegetable oils as the base greases. Vegetable oils in general are reacted with the lithium thickener in the same way that petroleum base oils are. The University of Northern Iowa's National Ag-Based Lubricants Center (UNI-NABL) has been a leading research center in the creation of manufacturing processes and biobased greases made from vegetable oils. Several commercial grease products including large volumes of rail curve grease made from soybean oils owe their origin to UNI-NABL. Since vegetable oils, in general, range in viscosity from 35-45 cSt at 40° C., UNI-NABL processes have included introduction of some higher viscosity vegetable oils, to increase the viscosity of the starting base oil.

Vegetable oils have a uniquely different behavior when exposed to high temperatures. In the case of some vegetable oils, once the oil temperature exceeds 150° C. (300° F.), the oil begins to oxidize rapidly and if steps are not taken to remedy this rapid oxidation, the product will begin to polymerize, resulting in irreversible change. In such cases, the product could partially or fully polymerize or change state from a soap into a polymer with no or little lubrication value. But, several methods exist for stabilizing soybean or other vegetable oils so they can be reacted with lithium and produce stable greases. The use of high oleic vegetable oils is often employed to improve the oxidation stability of the final product. Vegetable oils, due to their higher viscosity index, present a more stable body when exposed to high temperatures. As a result, properly formulated vegetable oil-based grease would show more stable body in use and would not thin down as fast as comparable mineral oil based greases when exposed to high temperatures.

What is clearly needed, however, are new and improved methods for manufacturing soap, and in turn, greases that are based upon such soaps, in a manner that provides ever better efficiencies and products.

BRIEF DESCRIPTION OF THE DRAWING

FIG. 1 is a table comparing the temperature of various materials before and after 90 second exposure to microwave energy.

FIG. 5 is a table various properties, including OSI, for corresponding renewable oil sources.

SUMMARY OF THE INVENTION

Figure 2:
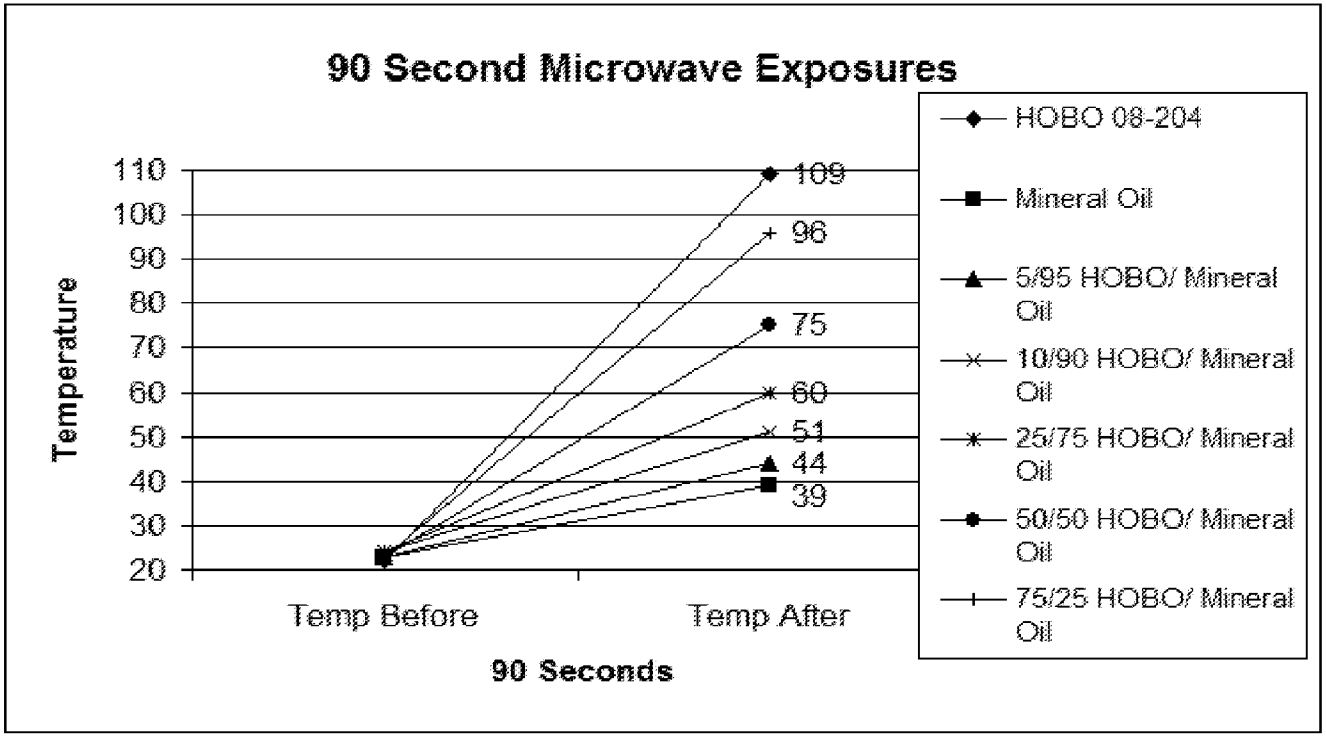
FIG. 2 is a chart showing temperatures before and after 90 second exposure to microwave for various materials.

The present invention provides a process, and corresponding apparatus and system for manufacturing soaps from various oil compositions, and in turn, for manufacturing greases that incorporate such soaps.

The word 'grease' as used herein will refer to a lubricating oil that is thickened, at least in part, with soap as a thickening agent. The word 'soap', as used with respect to the present invention, will refer to the neutralization reaction between an acid (e.g., fatty acid) and a base (e.g., lithium, calcium), along the lines described herein.

In a preferred embodiment, the process of this invention comprises the steps of:

a) providing a first oil composition comprising one or more fatty acids,
b) heating the first oil composition by the use of microwave energy to a desired reaction temperature (e.g., between about 100 C and about 150 C),
c) adding a basic reagent to the heated first oil composition in order to form a second composition,
d) heating the second composition by the use of microwave energy, under conditions suitable form a soap composition upon reaction between the basic reagent and fatty acids,
e) heating the soap composition using microwave energy in order to dehydrate the soap composition to a desired degree, and
f) combining the soap composition with one or more second oil compositions under conditions suitable to form a grease.

An apparatus of this invention, in turn, is preferably provided in the form of a microwave energy source suitable and adapted for irradiating, and in turn, heating the various compositions of this invention. Optionally, and preferably, a system of this invention can include a plurality of microwave energy sources, such that the corresponding compositions can be irradiated at various stations and/or stages, and in various ways (e.g., levels or rates) in the course of performing the process.

In turn, such an apparatus can be used within an overall system for manufacturing soap, and in turn, grease, in the course of heating by the application of microwave irradiation. The system will typically include one or more microwave apparatuses as described herein, in combination with corresponding devices, controls and the like for use in batch or continuous processing of these compositions. Such devices, for instance, preferably include one or more corresponding sensors operably connected to the system and adapted to provide real time readings of the temperature or other parameters associated with a respective composition.

Applicant has discovered, inter alia, that a soap, and in turn, grease of the present invention can provide an optimal combination of properties as compared to comparable soaps and greases prepared using conventional heating methods (e.g., hot plate, thermal blankets). The ability to provide more uniform and controllable heating can, in turn, help to make the entire process both faster and more efficient as well.

In a preferred embodiment, for instance, heating with microwave energy imparts significantly less oxidative damage to a composition as compared to the same composition when heated using conventional means. For instance, the term OSI (for "Oil Stability Index") is a value that often corresponds with the ability of an oil composition to resist oxidation. A suitable method for determining known as the AOCS test method Cd 12-92, the disclosure of which is incorporated herein by reference. In turn, it is typically the fact that the higher the OSI, generally the better suited the composition will be for use, both in terms of initially preparing a soap, and also in terms of using the soap or corresponding grease over a longer period of time. Though any heating process is likely to impart some damage to an oil composition, and in turn, lessen the OSI to some extent, Applicant has found that the method of the present invention can tend to lessen, or minimize such damage, and hence retain the OSI as high as reasonably possible. In turn, the method of this invention can permit the use of new oil compositions for the preparation of the soap and/or grease described herein, including in particular those oil compositions that would have otherwise had their OSI lessened by conventional heating to a point where they would not be useful for their intended purpose.

For instance, an oil composition of this invention can be treated in such a manner so as to provide an OSI that remains between about 40 to 80%, and more preferably about 50 to 70% of the OSI exhibited by the original, unheated composition. By contrast, the same composition, when heated using conventional means, will typically exhibit an OSI that is only between about 10 to 30% of the original.

The various ingredients that can be used in the process of this invention, including oil compositions and bases, will become apparent to those skilled in the art, given the present description.

Particularly preferred are oil compositions having a relatively high level of oxidation stability, including for instance, oils that are derived from plants that have been genetically engineered to provide particular fatty acid content (e.g., high oleic acid content).

Such oil compositions can be obtained from any suitable source, and preferably from renewable sources, such as plant oils, vegetable oils, edible and non-edible oils, animal fats and oils from algae and other materials that rely on photosynthesis to convert solar energy to renewable energy source of fatty nature.

In one embodiment, the first and second oil compositions can include, or be based upon, the same original source (e.g., soybean oil). Suitable sources and corresponding oils include apricot kernel, avocado, babassu, castor, coconut, corn, cottonseed, flaxseed, grapeseed, groundnut, hempseed, Jojoba—refined, Jojoba—golden, lard, linseed, macadamia, oleic acid, olive, palm kernel, palm, poppyseed, rape, ricebran, ricinoleic acid, safflower, sesame, soy, soy HOBO (08-204), sunflower, and walnut. These and other suitable oils or sources thereof can be found on FIG. 5 herein, together with relevant properties for each.

The first oil composition, which is used to make the soap, for use as a thickener, is preferably an oil with high level of oxidation stability, e.g., greater than about 50 hours, preferably greater than about 75 hours, and more preferably greater than about 100 hours. A second oil composition for use in this invention can similarly have greater than 50 hours, preferably greater than 75 hours, more preferably greater than 100 hours and even more preferably greater than 150 hours stability. Such oils are typically either naturally high in oleic acid content, or can be chemically modified to provide such compositions, or can be obtained from crops that have themselves been genetically modified, inter alia, in order to provide compositions having high levels of oxidation stability.

Bases suitable for use in the method of this invention are typically those that will be able to form a soap, when combined with the corresponding heated oil composition. Examples of suitable bases include various metals, more preferably metals (including salts and complexes thereof) selected from the group consisting of lithium, calcium, sodium, aluminum, and titanium.

Various additives can be, and preferably are, included as well in the grease composition, including those selected from the group consisting of anti-oxidants, anti-rust, anti-corrosion, anti-wear, extreme pressure improvers, pour point suppressants, colorants, scents, fillers including graphite, and various esters for cold temperature improvement.

Those skilled in the art, given the present description, will also be able to determine the manner in which an apparatus as described herein can be used to apply microwave energy in various ways, including continuously or intermittent energy delivery, at a constant or variable level. So too will those skilled be able to determine the manner in which the delivery of microwave energy can be determined and if desired adjusted, based upon various physical-chemical characteristics of the composition to be heated.

In turn, a system of this invention can include a plurality of microwave transmitters, e.g., some or all of which are connected in series or parallel in order to provide any desired level of energy (e.g., 50 to 500 kW) for use with large batch systems. Such a system can provide various benefits, including the ability to stop or start the delivery of energy essentially immediately. This can, in turn, provide for a safer system in case of emergency, such that only the compositions themselves may remain heated, as compared to the apparatuses as well. By contrast, in conventional systems that rely on the use of heat transfer oils, both the heat transfer oil and the reacted products are hot and need measures against emergency breakdowns.

Microwave frequency energy can be applied by irradiation to the various compositions of this invention, either in the absence or presence of fuel-fired heating or resistive heating. In order to control and optimize reaction exchange, various parameters, including the microwave frequency, power density, and field strength, can be controlled. Suitable control of these parameters influences the corresponding steps or reactions that may be desired. Furthermore the use of microwave energy can minimize secondary reactions and bring about a desired extent of reaction or conversion of the reactants.

See, for instance, US Patent Application Publ. No. 2005/0274065, which describes the manner in which the microwave dielectric parameters and energy absorption of plant oils and biodiesel have been characterized over the range of 0.6 to 6 GHz. The dielectric parameters and in particular the loss tangent which governs the microwave power absorption, can be shown to be nearly flat and independent of frequency for plant oils and biodiesel. These characterizations have shown that microwave absorption is sufficiently uniform that microwave energy is useful both within this frequency range and one skilled in the art can easily extrapolate that microwaves will be equally useful well outside of this range. For example, very high power, microwave sources, at 915 MHz and 2.45 GHz, are commercially available within the United States (other countries assign different high power microwave sources frequencies). Conversion rates are anticipated to be relatively independent of microwave frequency. A portion of the microwave frequency can be between about 1 MHz and about 100 GHz, more particularly, between about 100 MHz and about 10 GHz, and even more particularly, between about 400 MHz and about 5 GHz. Lower frequencies have longer wavelengths and therefore have greater penetration depth into the catalyst and reactants, which allows the design of physically larger reactors. The power density also may be controlled to enhance conversion. In one embodiment, the average power density is controlled between about 0.01 watts/cc and about 100 watts/cc, and particularly, between about 0.05 watts/cc and about 10 watts/cc, and even more particularly, between about 0.1 watts/cc and about 3 watts/cc.

The method, apparatus and system of this invention provide various potential benefits and options, many of which have not previously been possible or considered with regard to the manufacture of soap or grease. This is particularly helpful, given that oil compositions can tend to contain various ingredients (including fatty acid make-up), in varying amounts, and having varying properties (e.g., melting points), based on growth conditions, processing conditions and the like. The ability to apply microwave heating, of the type and in the manner provided herein, can be used to alter heat conditions accordingly, so as to provide consistent end products, regardless of initial variables.

Similarly, using the apparatus of this invention, one can control the manufacture of soap and grease in other ways as well. For instance, different fatty acids tend to have different properties, including different melting points. The apparatus of this invention can be used to selectively heat one or more of those different fatty acids, by the use of energy in a corresponding wavelength, while avoiding or minimizing energy being delivered to the other(s). For instance, in an oil composition that includes both oleic acid and linoleic acid, reaction with lithium will provide lithium oleate and lithium linoleate, respectively. The rate, absolute, and relative amounts of these reaction products can be adjusted by the delivery of microwave energy in an appropriate manner. These, and other such options and tools, can be used to improve the control, and in turn, consistency and predictability in the course of using oil compositions that themselves may tend to vary based upon source, growth conditions, processing parameters, and the like.

DETAILED DESCRIPTION

A process of this invention can be used to provide an optimal combination of attributes, in the course of preparing soaps, and in turn, lubricants including with regard to:

- Improved Yield—Yield refers to getting a higher consistency, thicker grease, with the same amount of thickeners, or more grease per unit of thickener.
- Reduction in energy requirements—Pressure, by using vessels, may speed up the chemical reaction and save energy.
- Reduced Production Time—Faster heating and reaction results in reduced production time.
- Versatility—To be able to heat and cool effectively and to control temperatures and other variables efficiently. Also, being able to switch from product to product and thickener to thickener will improve production and cycle time.
- Operation Savings—This can be determined based on the cost per pound of producing the grease. Cumulative savings are considered in the overall grease operation.
- Economical production with consistency and uniformity—Any process that results in a high level of repeatability and consistent product quality between batches is desirable.

Applicant now provides for the use of microwave heating for the saponification reaction of the vegetable oils with lithium. This process can be shown to provide significant improvements in the process of grease making, particularly with regard to minimizing the damage that can be done to vegetable oils in the course of heated reactions.

Vegetable oils due to their polar nature respond to microwave energy like water does, and can be effectively heated with surprisingly high efficiency. When polar molecules of vegetable oils are exposed to high energy microwaves, they vibrate through an omni-directional motion resulting in rapid heat rise. Mineral oils and non-polar liquids, when exposed to microwaves, do not vibrate. Instead they pick up speed and can rotate resulting in less friction at the molecular level and less heat generation.

In one preferred embodiment, the present invention includes the use of microwave energy for heating vegetable oils for grease processing and to: a) avoid degradation of oxidation stability due to exposure to high temperatures at the point of contact with the walls of the heating vessels; b) reduce the time needed to heat the oil to the needed reaction temperatures; c) reduce the energy consumption by a more focused and instantaneous energy input; and finally d) reduce the level of fire hazard by eliminating the use of high temperature heat transfer oils.

The following practical examples are provided to reinforce the theory behind the effective use of microwave energy for manufacturing of biobased grease.

FIG. 1*a* shows exposure of 300 ml of mineral oil and vegetable oil to 90 seconds of microwave energy through a 1.75 KW transmitter; and then mixtures of mineral oil and vegetable oil and heating with the same level of microwave exposed to 1.75 kw of microwave energy, while FIG. 1*b* shows the same oil heated on a hot plate which was set and brought to temperature at 300° C.

To simulate heating by conduction and convection, a sample of 300 ml of vegetable oil was place on a hot plate which was heated to 300° C. to record the time needed to raise the temperature to 160° C. Similarly the oil was exposed to microwave energy to reach to 160° C. The following chart presents the results of this experiment, with noticeable differences in the time required.

Understandably the hot plate method of heating will expose the heated oil to a longer period of heat loss from the walls of the beaker, and more accurate results would need an adiabatic environment. Nevertheless, this example shows the time savings involved with the use of microwave energy when heating polar materials.

To further investigate the effect of heating by microwave energy vs. conventional heating, a sample of vegetable oil was, with known oxidation stability index, heated to 165° C. on the hot plate for 7 hours, and a same size sample of the same oil was heated to 165° C. by microwave heating. This was then maintained at the same temperature by pulsing one minute of energy every 5 minutes for 7 hours. The two oils were then tested for their oil stability index, using an Oxidation Stability Instrument. The results indicated that that both oils oxidized, but the oil exposed to the heating on the hot plate had a delta viscosity of 2× that of the oil heated by microwave. Future reports will show that these trials can be duplicated in larger quantities with higher levels of microwave energy.

FIG. 1 is a table comparing the temperature of various materials before and after 90 second exposure to microwave energy. The table shows that a vegetable oil (HOBO) could absorb microwave energy in order to become heated much more rapidly than a corresponding volume of a petroleum oil (mineral oil), with combinations of the two materials appearing to provide a linear relationship (as shown in FIG. 2).

FIG. 2 is a chart showing temperatures before and after 90 second exposure to microwave for various materials.

Figure 3:
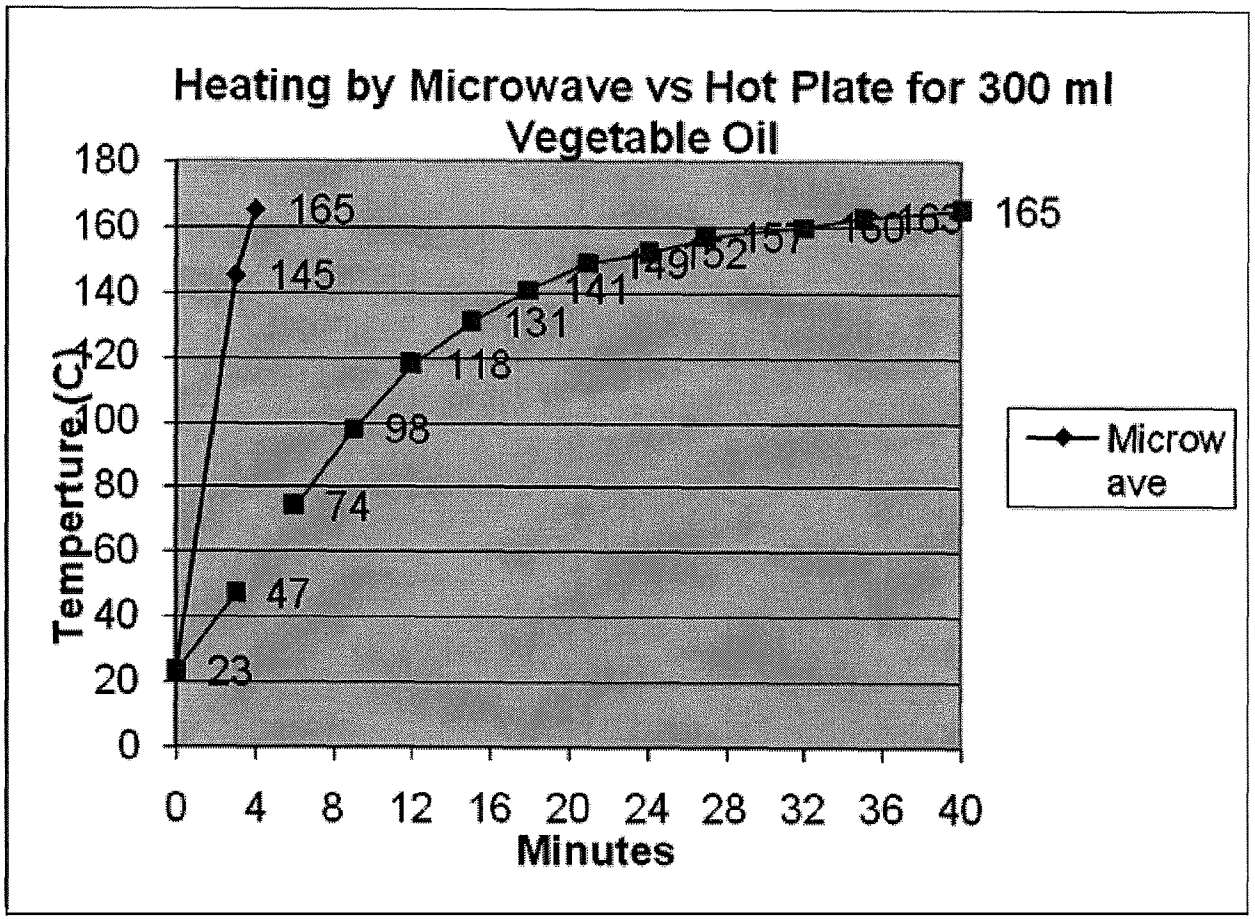
FIG. 3 is a chart showing the effect of heating by microwave versus hotplate on various samples.

FIG. 3 is a chart showing the effect of heating by microwave versus hotplate on various samples. It can be seen in this Figure that the same volume of oil, can be heated to 165 C in only 4 minutes using microwave irradiation, as compared to about 40 min using a conventional hot plate. In turn, it can be seen that more energy is retained by means of microwave, and heat loss is reduced considerably.

Figure 4:
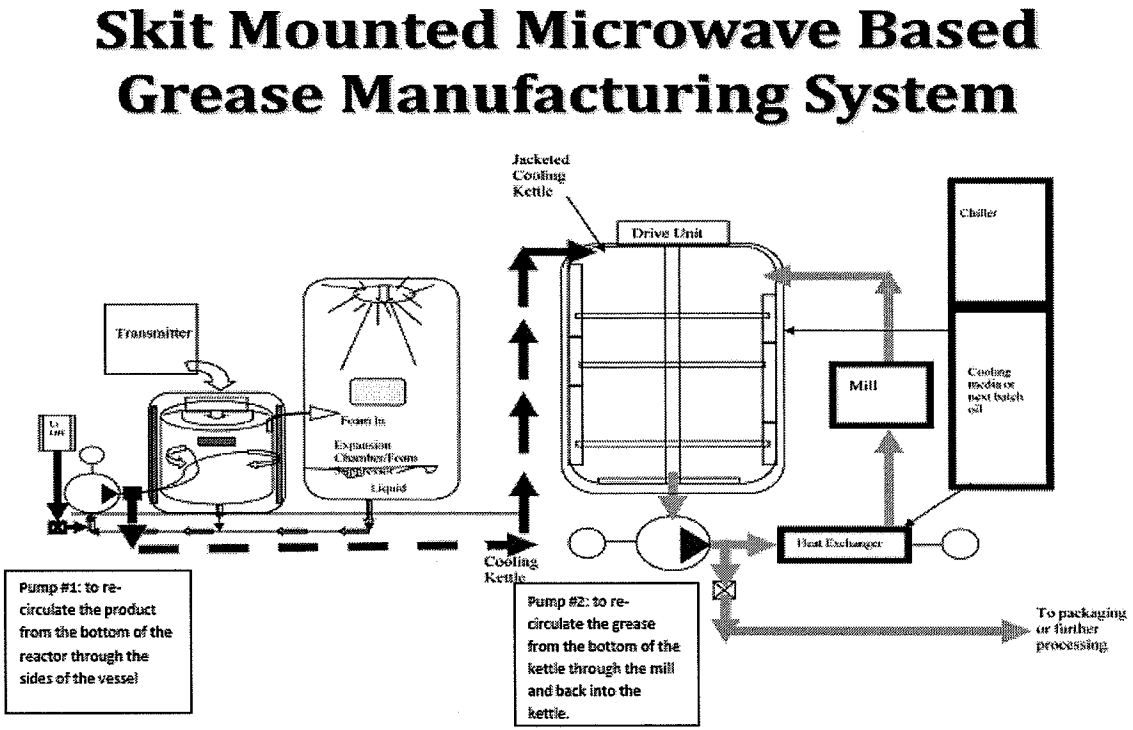
FIG. 4 is a diagram showing various parts of a system of this invention.

FIG. 4 is a diagram showing various parts of a system of this invention.

FIG. 5 is a table showing various properties, including OSI, for corresponding renewable oil sources.

The present invention has been based on using microwave energy for three important reasons. First, to reduce the oxidation breakdown of vegetable oils by reducing the amount of time it takes to heat the oil. By using microwave energy to heat vegetable oils, the concentrated amount of energy results in achieving the desired temperatures in shorter periods of time. The type of heating is also uniform, and does not result in hot spots and no need for stirring. Stirring is typically needed in conventional processes, to prevent hot spots, but further exacerbates thermal oxidation and breakdown of the oil because it can introduce air into the process. In manufacturing petroleum grease, thermal oxidation is not noticeable and as a result has not been considered a problem. But, vegetable oils are more sensitive to thermal oxidation. As a result, using microwave heating can play a significant role in improving the manufacturing process and making vegetable oil based greases more competitive.

Suitable microwave transmitters are commercially available, such as the AMTek Microwave Transmitter which can be used as a single, self-contained microwave power unit, where it delivers power levels from 5 to 75 kW's continuous rated duty. Or it can be used in combination with other AMTek transmitters to provide "networked" microwave power to any processes requiring higher power levels. Our transmitters are compatible with any other applicator requiring the need for microwave power.

Key features of such a transmitter, include one or more of the following: a) transmitter controls hardware accessed without entering the main enclosure, b) "open" interior design over traditional hardware, c) digital control of the external cooling loop water usage, d) solid state filament and solenoid power supplies, e) available in remote I/O or standalone control hardware configurations, f) complete finger safe construction, g) Din Rail and wire duct construction for ease of modification, g) high powered circulator assembly, h) external heat exchanger system with removable union fittings installed, i) complete package of interlocks monitoring the entire transmitters operation, j) analog metering of the anode and solenoid current levels, k) dual disconnects with shut trips for the highest level of operator safety, 1) optional standalone configuration with a touch panel in the control panel front.

Such a transmitter assembly provides a dependable source for industrial microwave power. Designed using the latest AB controls hardware with flexible design and construction, to provide a unit ideal for virtually any application requiring microwave power. In turn, microwave energy can be concentrated onto the product to provide uniform heating without the need for agitation. This has shown to improve the energy efficiency of the process by as much as 50%. Saving energy while improving the predictability of the process could result in considerable cost savings for the grease manufacturers.

Finally, using microwave energy for the process of grease making will reduce the fire hazard for grease manufacturers. Microwave energy can be focused in any suitable manner, e.g., on reaction vessels themselves, and/or on one or more sections of the process piping, where product reaction takes place; thus, eliminating the need for tens of gallons of heat transfer oil and the accompanying boiler system. In conventional heating operations, the reaction kettle and the heat transfer lines must be insulated to reduce heat loss due to conduction and convection. The microwave heating process has the potential to eliminate a large amount of heat loss; thus, improving the overall efficiency of the process as well.

A process for producing bio-based grease, comprising the use of microwave energy for heating vegetable oils in order to produce grease. The process minimizes or avoids degradation of oxidation stability due to exposure to high temperatures at the point of contact with the walls of the heating vessels. The process substantially reduces the time needed to heat the oil to the needed reaction temperatures, as compared to conventional processes. The process substantially reduces the energy consumption by a more focused and instantaneous energy input, as compared to conventional processes, and substantially reduces the level of fire hazard by eliminating the use of high temperature heat transfer oils. Preferably the grease is biobased and biodegradable, and prepared using vegetable oils as the base oil.

The invention further provides a grease prepared by combination of a soap composition, formed by reaction between a first oil composition and a reactive base, with a second oil composition, wherein the soap composition and grease have been prepared by the application of microwave irradiation. Preferably, the grease exhibits at least 10%, and more preferably at least 20%, less oxidative damage than a comparable grease prepared using conventional heating, when determined according to the Bearing Oxidation Test of ASTM D3527.

What is claimed is:

1. A process for preparing grease, comprising the steps of:

a) providing a first oil composition comprising one or more fatty acids, b) heating the first oil composition by the use of microwave energy to a desired reaction temperature, c) adding a basic reagent to the heated first oil composition in order to form a second composition, d) heating the second composition by the use of microwave energy, under conditions suitable to form a soap composition upon reaction between the basic reagent and fatty acids, e) heating the soap composition using microwave energy in order to dehydrate the soap composition to a desired degree, and f) combining the soap composition with one or more second oil compositions under conditions suitable to form a grease.

2. A process according to claim 1, wherein the first and second oil compositions each comprise a vegetable oil.

3. A process according to claim 2, wherein the vegetable oil is selected from the group consisting of apricot kernel, avocado, babassu, castor, coconut, corn, cottonseed, flaxseed, grapeseed, groundnut, hempseed, Jojoba—refined, Jojoba—golden, lard, linseed, macadamia, oleic acid, olive, palm kernel, palm, poppyseed, rape, ricebran, ricinoleic acid, safflower, sesame, soy, soy HOBO (08-204), sunflower, and walnut.

4. A process according to claim 3, wherein the first and second oil compositions are the same.

5. A process according to claim 3, wherein the first and second oil compositions are different.

6. A process according to claim 1, wherein the basis reagent comprises lithium.

7. A process according to claim 1, wherein one or more additives are added to the grease.

* * * * *